US006453966B1

(12) United States Patent
Ostroff

(10) Patent No.: US 6,453,966 B1
(45) Date of Patent: Sep. 24, 2002

(54) APPARATUS FOR WRAPPING A LAYER OF MATERIAL ON A RECYCLED CORE

(75) Inventor: Stuart Ostroff, Abington, PA (US)

(73) Assignee: CSI Core Specialties Inc., St. Laurent (CA)

( * ) Notice: Subject to any disclaimer, the term of this patent is extended or adjusted under 35 U.S.C. 154(b) by 0 days.

(21) Appl. No.: 09/540,447

(22) Filed: Mar. 31, 2000

Related U.S. Application Data

(62) Division of application No. 09/041,682, filed on Mar. 13, 1998, now Pat. No. 6,051,092, which is a division of application No. 08/639,483, filed on Apr. 29, 1996, now Pat. No. 5,845,871.

(51) Int. Cl.[7] ..... B31C 11/00; B32B 31/00

(52) U.S. Cl. ..... 156/447; 156/443; 156/446; 156/450; 156/458

(58) Field of Search ..... 156/184, 185, 156/187, 192, 443, 446, 449, 450, 458; 493/303; 264/610.1

(56) References Cited

U.S. PATENT DOCUMENTS 3,555,976 A * 1/1971 Carter et al. ..... 93/80
3,580,442 A * 5/1971 Rohdin ..... 225/2
3,656,513 A * 4/1972 Evans et al. ..... 138/141
4,484,968 A * 11/1984 Quist et al. ..... 156/160
5,251,809 A * 10/1993 Drummond et al. ..... 229/202
RE35,304 E * 7/1996 Biagotti ..... 156/446
5,829,669 A * 11/1998 Drummond et al. ..... 229/4.5

* cited by examiner

*Primary Examiner*—Richard Crispino
*Assistant Examiner*—Sue A. Purvis
(74) *Attorney, Agent, or Firm*—Diller, Ramik & Wight

(57) ABSTRACT

Winding cores for the paper industry are restored by removing the metal tips from the ends of the core, trimming the core to eliminate the crimped end portions of the core, providing complementary male and female joint ends to the core, grinding the outer surface of the core to a constant outer diameter less than the industry standard outer diameter to accommodate a finishing layer. The cores with the complementary joints are pressed end to end to form a core master prior to its being ground and then picking up the core masters one by one and bringing them into proximity of a web of liner board material having a length which corresponds to the length of the core master and a width which corresponds to the circumference of the core, contacting the glue bearing liner board web with the core and rotating the core to wrap the web of liner board about the core to provide a finished restored core. The core master is then cut into suitable length winding cores.

6 Claims, 10 Drawing Sheets

APPARATUS FOR WRAPPING A LAYER OF MATERIAL ON A RECYCLED CORE

CROSS-REFERENCE TO RELATED APPLICATIONS

This application is a divisional application of U.S. patent application Ser. No. 09/041,682, filed Mar. 13, 1998, now U.S. Pat. No. 6,051,092, issued Apr. 18, 2000, which is a divisional application of U.S. patent application Ser. No. 08/639,483, filed Apr. 29, 1996, now U.S. Pat. No. 5,845,871, issued Dec. 8, 1998.

BACKGROUND OF THE INVENTION

1. Field of the Invention

This invention relates to a method and apparatus for restoring cores, and more particularly, cores utilized for accommodating a roll of paper.

2. Description of the Prior Art

Newsprint and other paper used for printing is generally shipped from the paper mill in large rolls. When the rolls are made up at the paper mill, they are wound on a tubular core. Typically the cores are made of liner board and are usually provided with metal caps of the type described in U.S. Pat. No. 5,271,258, issued Dec. 21, 1993 to Bernier et al.

In the press room or other printing plant, the roll is mounted on an unwind apparatus with the core of the roll journaled on mandrels. Once the web of paper has been unwound from the core, the core is generally discarded or returned to a paper mill to be recycled as waste fiber. The core caps are first removed and restored for further use or sold for scrap.

The paper rolls are wound and unwound at high speeds and are, therefore, susceptible to misalignment while being wound, resulting in improper registry on the printing press, requiring constant alignment correction. A slight inconsistency in the outer diameter of 0.25 inches will cause the paper web, when being wound, to move away from the end of the core that includes the portion with the larger diameter. It is important, therefore, that the outer diameter be constant and retain its circular cylindrical configuration. Likewise, the inner diameter must not vary so that the axis of rotation is at the true center of the core and thus the roll of paper. Any out-of-center rotation will cause similar winding and unwinding problems.

Thus, it has not been contemplated to reuse a winding core once it has been utilized once other than to cut the core down to a smaller size. It has been found that after a single use, the winding core has been somewhat damaged. Even though such damage may appear negligible, the distortions in the outer diameter or center of rotation are usually unacceptable. Thus, the practice in industry is to discard the winding cores once a roll of paper web has been unwound therefrom. The discarded single use winding core is then returned to the paper mill as scrap liner board to be recycled as paper fiber.

SUMMARY OF THE INVENTION

It is an aim of the present invention to reclaim discarded winding cores and to restore such cores to acceptable standards such that the restored winding core can be reused as a winding core.

It is a further aim of the present invention to provide a method for restoring winding cores.

It is a further aim of the present invention to provide an apparatus to economically restore such discarded winding cores.

It is a still further aim of the present invention to provide an improved winding core with superior dimensional parameters compared to conventional winding cores.

A method in accordance with the present invention comprises the steps of collecting used winding cores, passing each core through a station for trimming the ends of each core, passing each core through a coning station for centering the core in relation to its outer diameter, grinding the outer surface of each core to a constant diameter equivalent to an outer diameter standard less the thickness of a finishing web of fiber material, providing a finishing web of fiber material with a length corresponding to the length of the winding core being restored and having a width equal to the circumference of the core being restored, and wrapping the finishing web of paper about the core being restored.

In a more specific embodiment of the present invention, the method includes the steps of recuperating used cores, selecting the winding cores by grade and length, passing each core through a core tip puller station for removing the steel tips from the ends of the cores, trimming the ends of the cores to remove crimping portions thereof, passing each core through a coning station for centering the cores in relation to their outer diameter, forming a female joint socket at one end thereof and a complementary male joint socket at the other end thereof, joining the cores end to end with adhesive to form an elongated multiple-length core master, grinding the outer surface of the core master to a constant diameter equivalent to a predetermined outer diameter standard less the thickness of a finishing web of paper, providing an elongated web of finishing material equivalent to the length of the multi-length core master, and wrapping the web about the core with adhesive so as to provide a constant outer diameter equivalent to the predetermined standard, and then cutting the multi-length core master to desired core lengths.

An apparatus in accordance with the present invention comprises a cutting table for trimming the ends of each winding core wherein saw means are provided for cutting off the ends of each core in order to remove any crimping marks, a coning station downstream of said cutting table wherein coning means are provided for centering the individual cores in relation to their outer diameters, grinding means for grinding the outer surface of the core to a predetermined constant diameter, and means for wrapping a finishing web of paper on the ground surface of the core, including a table for laying an elongated web of finishing paper having a length corresponding to the length of the core and a width corresponding to the circumference of the core, and means for wrapping the finishing web of paper on the core with adhesive.

An apparatus in accordance with a more specific embodiment of the present invention comprises a cutting table having a pair of spaced-apart cutting saws whereby the distance between the cutting saws can be adjusted to the equivalent of the length of the core being trimmed less the accumulated length of the portions of the ends to be trimmed, a coning station including a pair of spaced-apart heads each adapted to engage opposite ends of a trimmed core for the purpose of forming complementary female and male joints on the opposite ends of the core, means downstream of the coning station for joining the cores end to end to form a master core of a predetermined length representing multiple cores, a grinding station being arranged downstream thereof and including feeding means for feeding the so-formed master core by a rotating grinding wheel for grinding the core to a predetermined constant outer diameter, and the means for wrapping a finishing web of paper including a skiver for skiving the longitudinal edges of the web of finishing paper, means for applying glue to one surface of the web to be in contact with the core, the web wrapping station including a table, a web feeder for feeding a predetermined length of web onto the table from a continuous roll, means for picking up and laying the core master on the web, means for wrapping the length of web about the circumference of the core master with the skived edges overlapping, and means for cutting the core master into predetermined core lengths.

In another aspect of the present invention, there is provided an apparatus for wrapping a layer of material about a cylinder including an elongated frame, a material web feeding means at one end of the frame for feeding a predetermined length of web of material horizontally and longitudinally of the frame, the web having a width equal to the circumference of the cylinder, glue means for applying adhesive to the web, means for picking up and positioning a cylinder over the web of material on the elongated frame so that the axis of the cylinder is parallel to the longitudinal axis of the web of material, means for bringing the web of material and the cylinder into contact such that the adhesive will engage the surface of the cylinder, and means for rotating the cylinder so that the web of material is wrapped completely about the cylinder.

A winding core for transporting a web of paper in accordance with another aspect of the present invention comprises a circular cylindrical tube having ends and a predetermined circumference, the tube having a first spiral fiber board substrate and a web of fiber board material having a length equal to the length of the tube and a width corresponding to the circumference of the tube, the web of material having skived longitudinal edges, wherein the web of material is wrapped about the tube and forming a longitudinal seam made up of the longitudinal skived edges of the web that have been overlapped.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
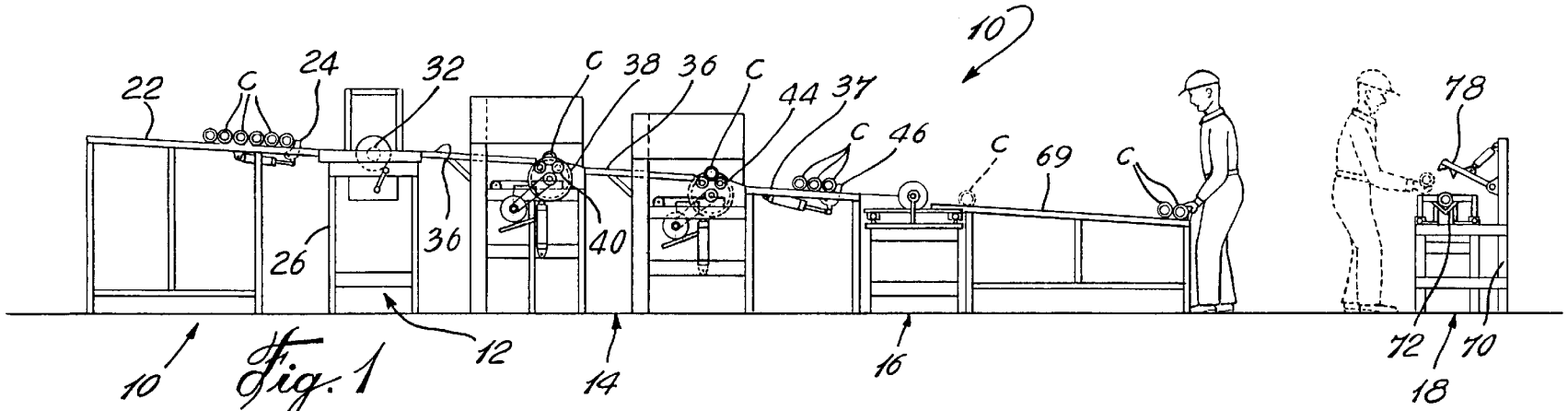
FIG. 1 is a side elevation showing a series of stations for partially restoring a winding core.
Figure 2:
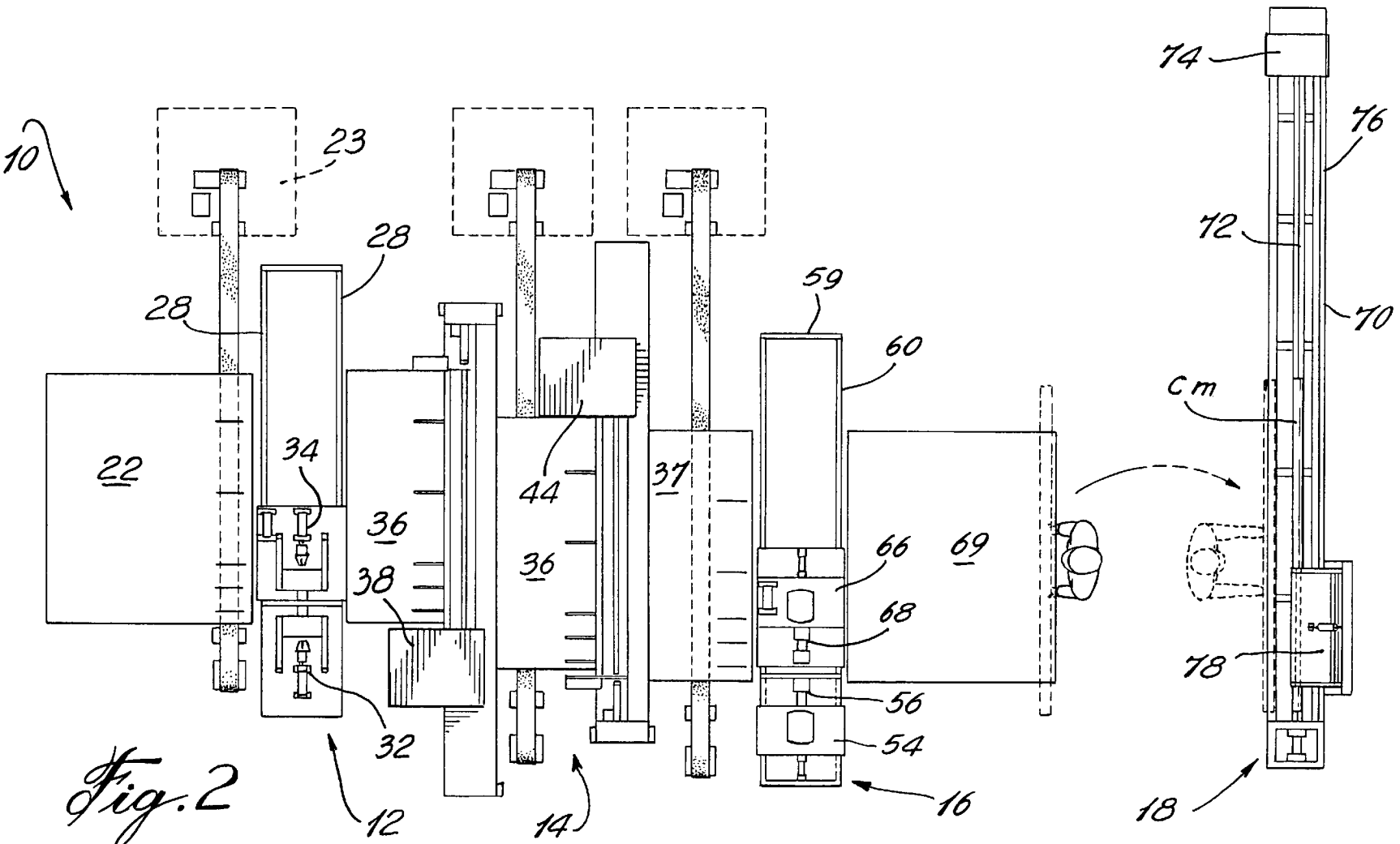
FIG. 2 is a top elevation of the apparatus shown in FIG. 1.

Referring now to FIGS. 1 and 2, there is shown a core preparation table 10 having an inlet table 22 on which previously used or discarded cores C can be stored after they have been sorted according to grade and length.

For instance, the winding core C, which is normally made of a fiber board material, can come in different crush resistant categories, such as 400 lbs., 500 lbs., or 750 lbs. Eighty per cent of the winding cores are in a range of 55 inches, but this might vary. Most cores will have metal end caps at each end of the core C. Thus, a preselected batch of discarded used cores C are located on table 22 upstream of metal tip puller station 12.

Downstream of the metal tip puller station 12 is a trimming station 14 made up, in the present embodiment, of two identical but reversed saw tables for trimming the ends of the cores. The next downstream station is a coning machine 16 best seen in FIGS. 4 and 5. The coning machine 16 serves to form a male joint on one end of the core C and a female socket at the other end.

Figure 6:
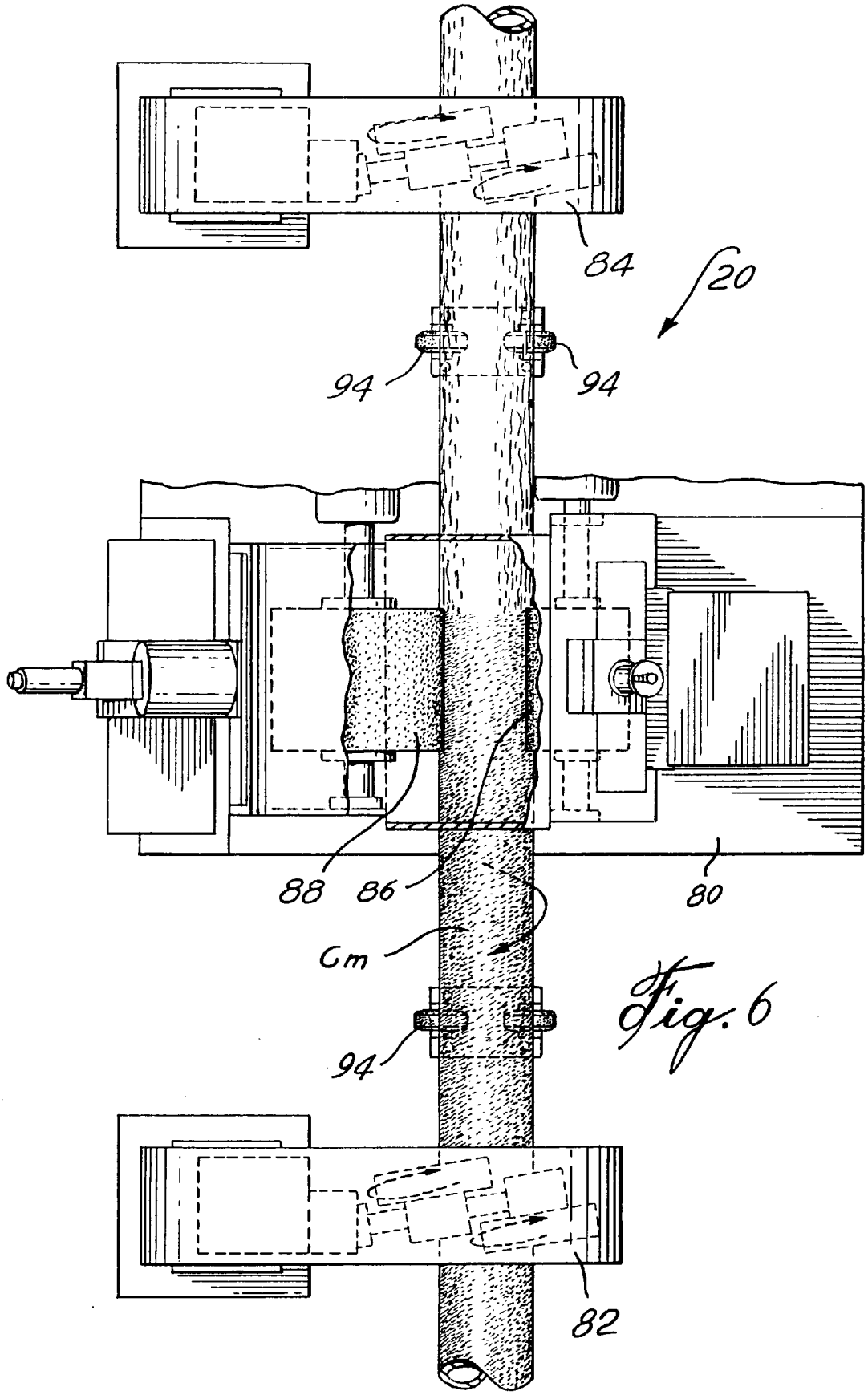
FIG. 6 is a fragmentary top elevation of a further station in the restoring of the winding core which would be downstream of the apparatus shown in FIGS. 1 and 2.
Figure 7:
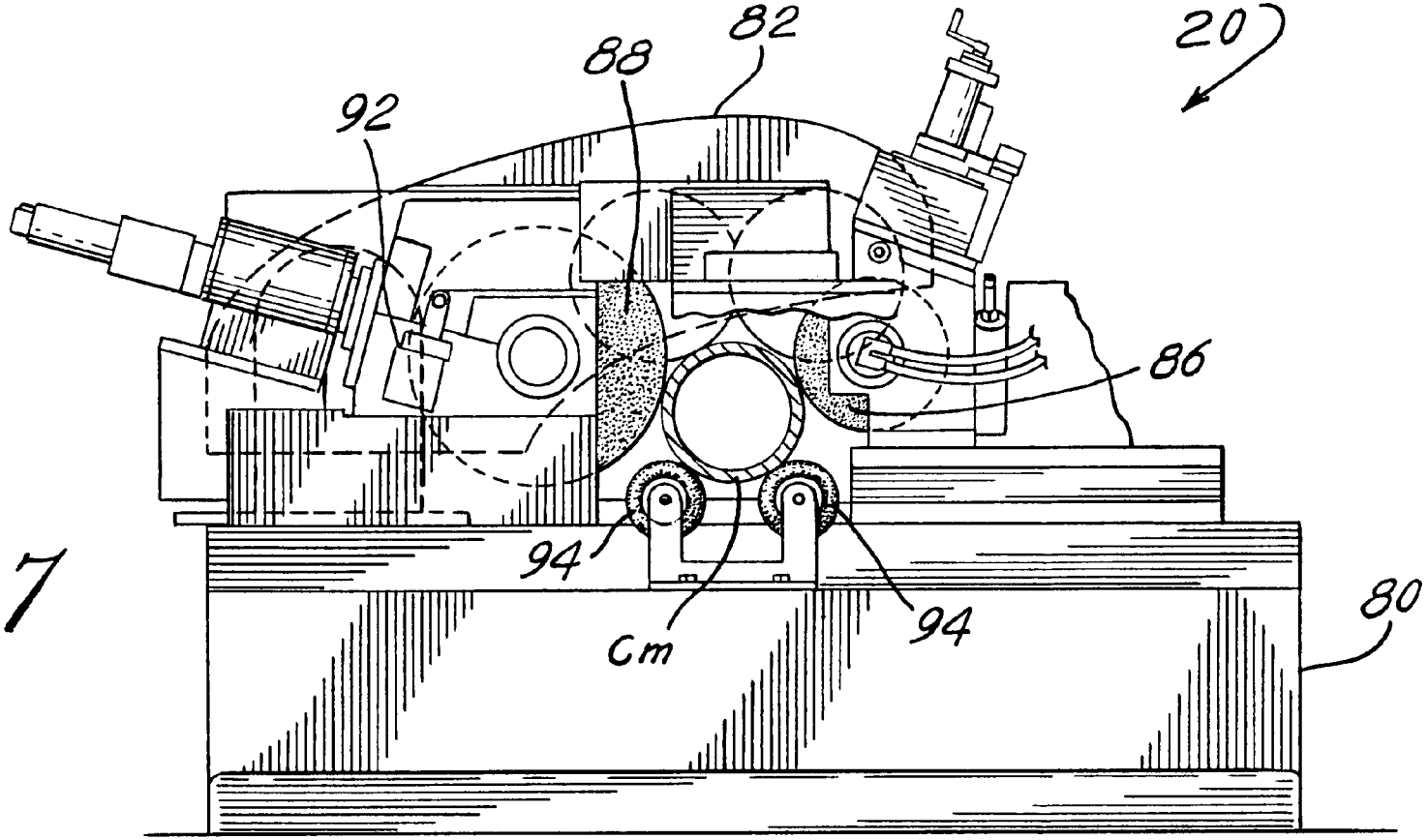
FIG. 7 is an elevation of the station shown in FIG. 6.

Station 18, shown in FIGS. 1 and 2, serves to press a series of cores C together to form a core master $C_M$. Downstream of the press machine 18, as shown in FIGS. 6 and 7, is a grinder 20. Finally, to complete the process, a core wrapping apparatus 100, as shown in FIGS. 8 through 14, is located downstream of the grinder 20.

Figure 3:
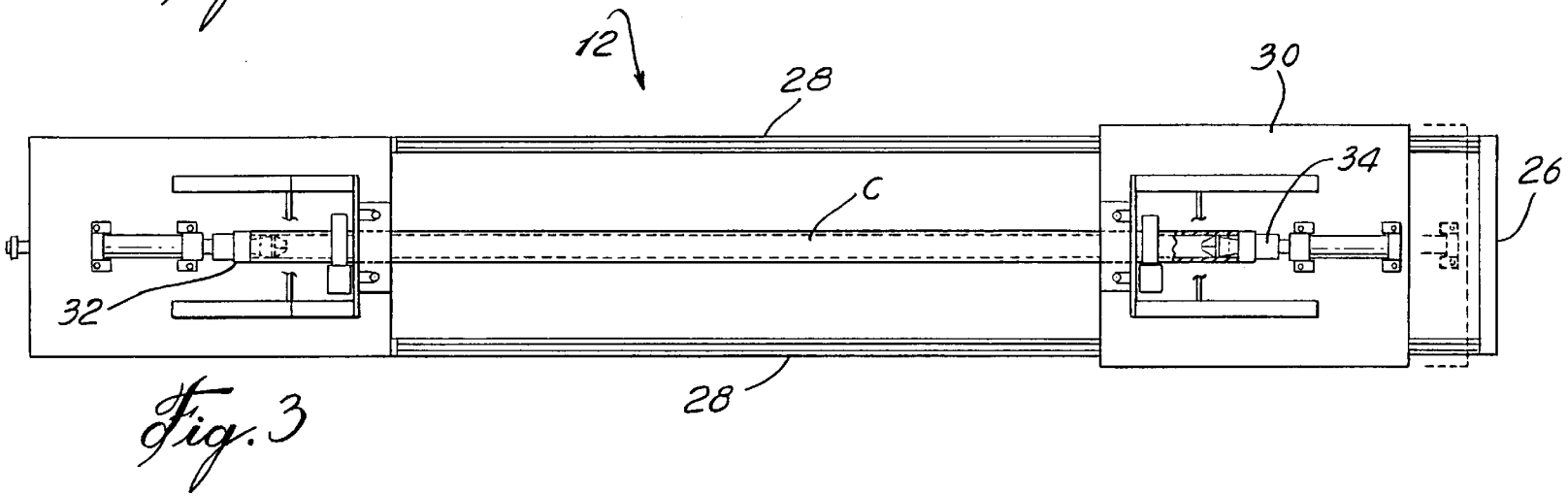
FIG. 3 is a top elevation of a station shown in FIG. 1.

Referring now to FIGS. 1 through 5, the inlet table 22 is provided with a hydraulically operated gate member 24 associated with a slightly sloped table surface to allow cores C to advance one by one towards the metal tip puller station 12. As shown in FIG. 3, the metal tip puller station 12 includes track 28 and a carriage 30 which travels on the track 28. Puller head 32 is located on one end of the frame, as shown in FIG. 3, and an identical puller head 34 is located on the carriage 30. The carriage 30 will move towards the puller head 32 when a core is located on the frame 26 to engage the ends such that the puller heads will engage the metal tips, and the carriage 30 will retract to remove the metal tips from the core C. The metal tips will be dumped from the respective puller heads 32 and 34 into a storage bin 23 for restoration of these metal tips.

The core C then advances through to station 14. As shown in FIGS. 1 and 2, one end of the core will be cut by saw 38 as it comes off feed table 36. The purpose of the saw 38 is to remove one end of the core which may have crimp marks, such as from the metal tips or caps. The core then passes through the next saw 44 in station 14 to cut off the other end of the core in a like manner. These circular saws 38 and 44 are readily available. The core is trimmed on both ends to be reduced to 48.5 inches from an original 55 inches.

Figure 5:
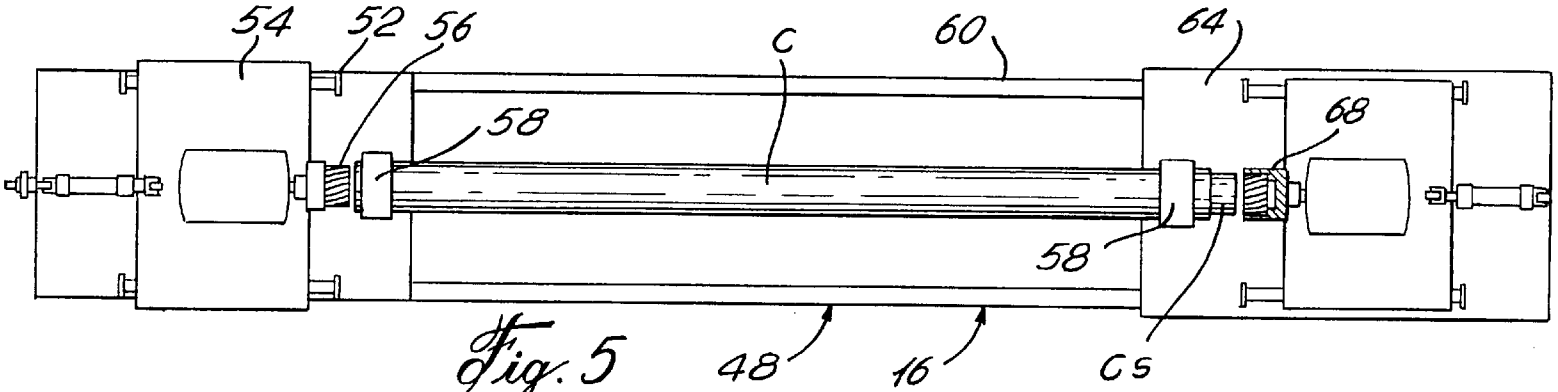
FIG. 5 is a top plan view of the station shown in FIG. 4.
Figure 4:
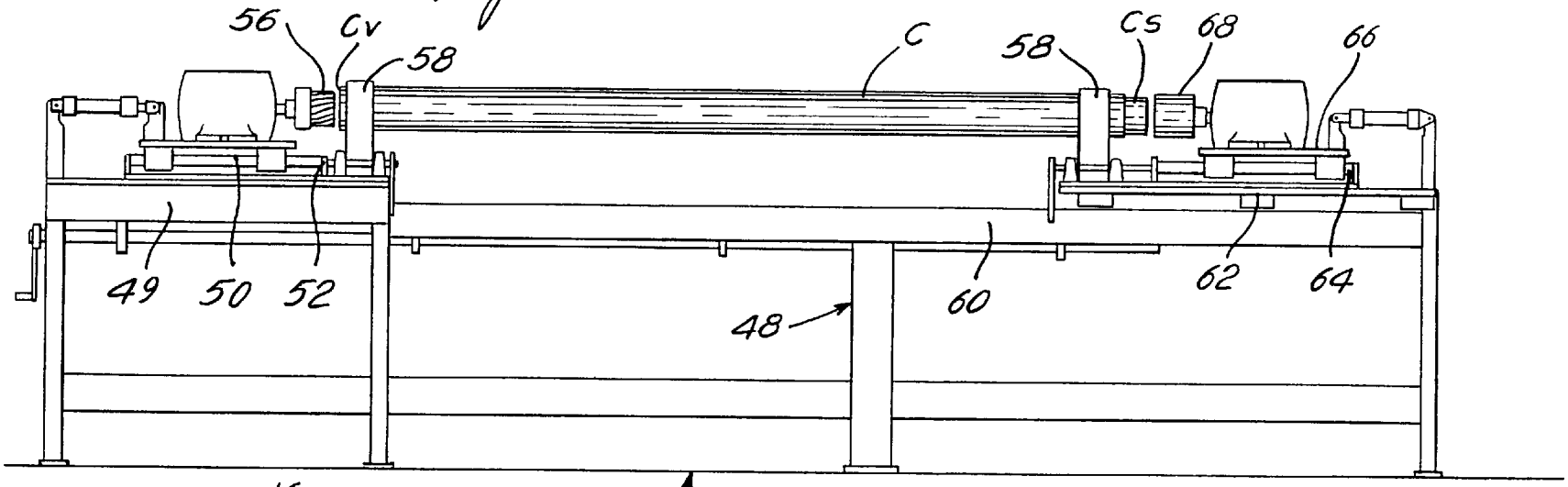
FIG. 4 is a side elevation of a further station shown in FIG. 1.

The core C then moves on feeding table 37 to be engaged by the coning station 16. As shown in FIGS. 4 and 5, the coning station 16 includes a frame 48 having a track 60. A track 50 is mounted at one end of the frame 48 on platform 49. A carriage 52 travels on the track 50, and the carriage 52 mounts a router 56. Router 56 is the female router, and the carriage 52 moves towards one end of the core C which is held in a holder 58 near the end. Holder 58 is provided with measuring devices for measuring the outer diameter of the core. These measuring devices can measure the outer diameter of the core 300 times a minute.

A female socket $C_V$ is formed by router 56 with reference to the outer diameter. A router 68 is mounted on a subcarriage 66 mounted on a subtrack 64. The subtrack 64 is mounted on the carriage 62 which in turn travels on the track 60 of the frame 48. An outer diameter measuring device and holder 58 is mounted on the carriage 62. The router 68 forms the male joint $C_S$ in reference to the outer diameter.

The core C is then delivered on table 69 and, in the present instance, is manually laid in the press station 18 in a V-shaped trough 72 on elongated frame 70. A press head 74 travels on the track 76 towards the aligned cores C in the trough 72. Adhesive is applied to the joints $C_V$ and $C_S$ of each core C. Several cores C will be located end to end on the trough 72, and the press head 74 moves to press the core sections in order that the jointed ends $C_V$ and $C_S$ be coupled together to form a core master $C_M$.

Typically, a core master $C_M$ will measure 180 inches and will be handled in the remainder of the core restoring apparatus as cylindrical core master $C_M$.

Referring now to FIGS. 6 and 7, the core master $C_M$ is passed through a grinder 20 which includes a grinding head frame 80. Adjustable grinding wheels 86 and 88, as shown in FIG. 7 and partially in FIG. 6, are effective for grinding the surface of the core master $C_M$. The grinding machine 20 may be a Cincinnati grinding mill of the type known as Milacron (trade-mark) Twin Grip Centerless Grinder. Each of the grinding wheels is mounted with anti-friction profile truing in order to precisely grind the outer surface of the core $C_M$ to a constant outer diameter. Typically, since the finished core should have an industry standard of 4.010 inches outer diameter, the grinding mill 20 will provide an outer diameter of 3.985 inches on the cores $C_M$. Once the finishing web of liner board has been wrapped around the core, the core should reach an outer diameter of 4.010 inches.

The core $C_M$ is driven past the grinding wheels 86 and 88 by means of driven wheel assemblies 82 and 84, and the core $C_M$ is supported on idler wheel assembly 94.

Cores that are provided with metal end caps generally have an internal diameter of 3.072 inches. If, however, the core is not intended to be used with a metal end cap, the internal diameter is 3.000 inches.

Once the core $C_M$ has been ground to its outer diameter of 3.985 inches, it is then sent to the wrapping assembly 100. Reference is made to FIGS. 8 through 14 with respect to the wrapping assembly 100.

Figures 8, 9:
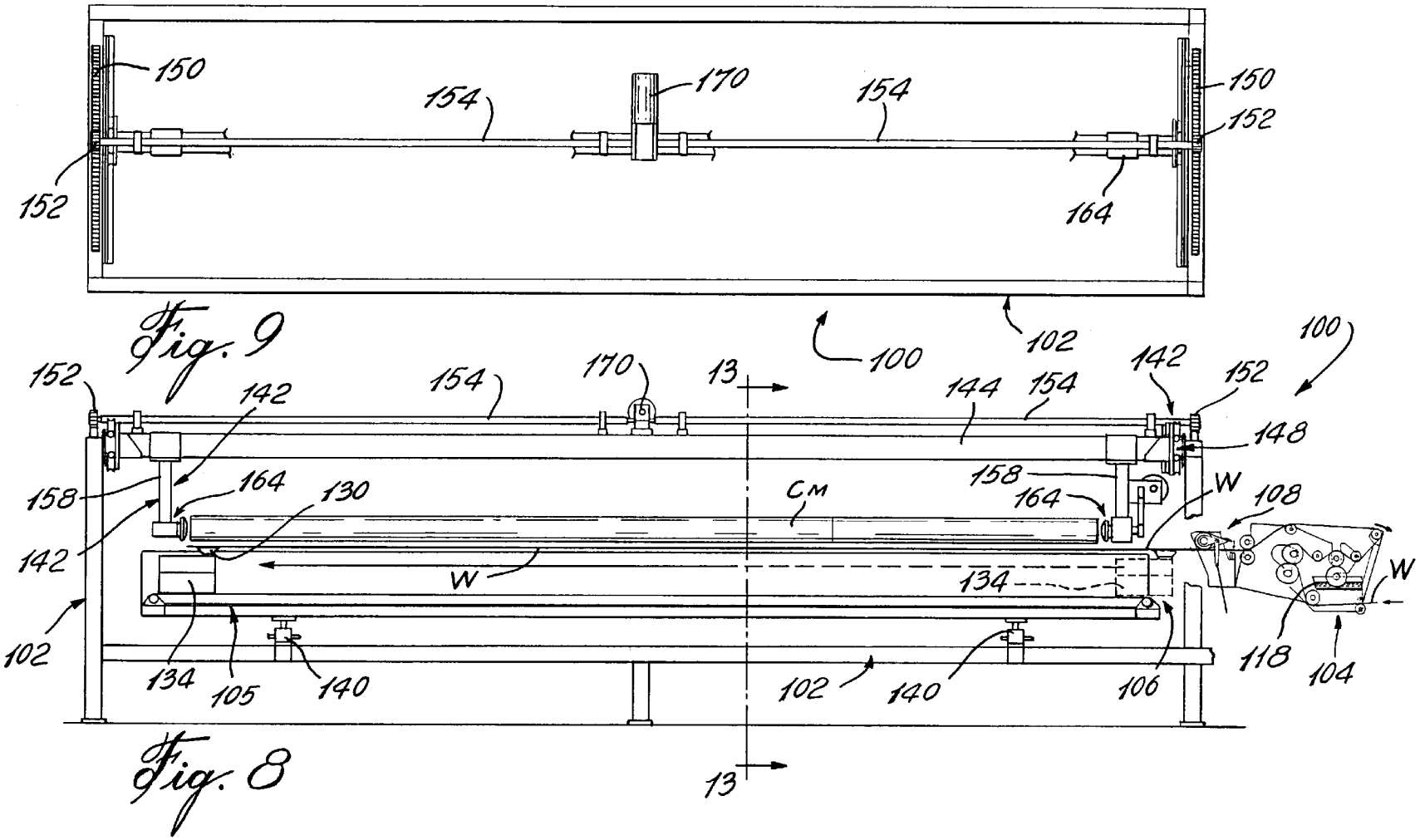
FIG. 8 is a side elevation of a further station utilized in the restoring of the winding cores downstream of the station shown in FIGS. 6 and 7.
FIG. 9 is a fragmentary top plan view of the station shown in FIG. 8.
Figure 10:
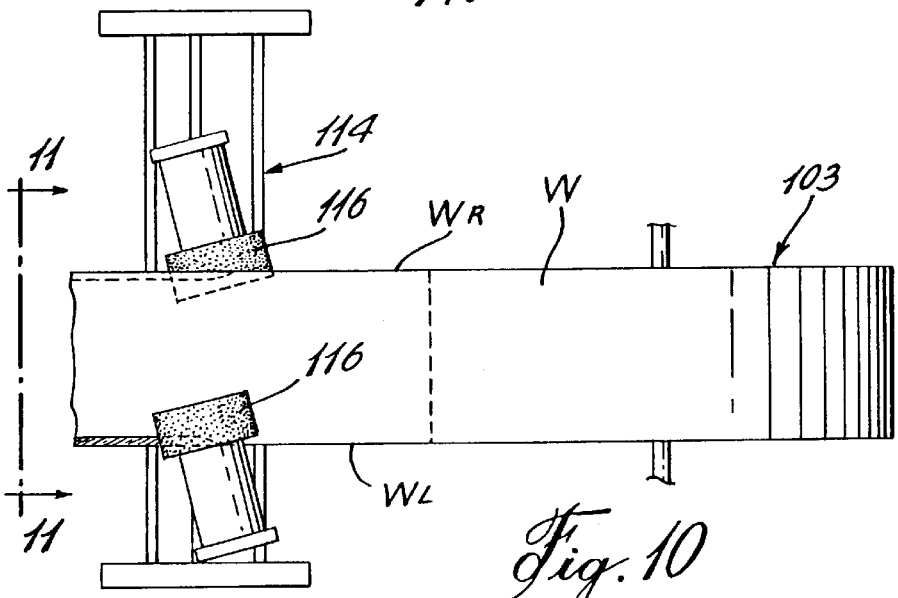
FIG. 10 is a top elevation of a further station associated with the station shown in FIGS. 8 and 9.
Figure 14:
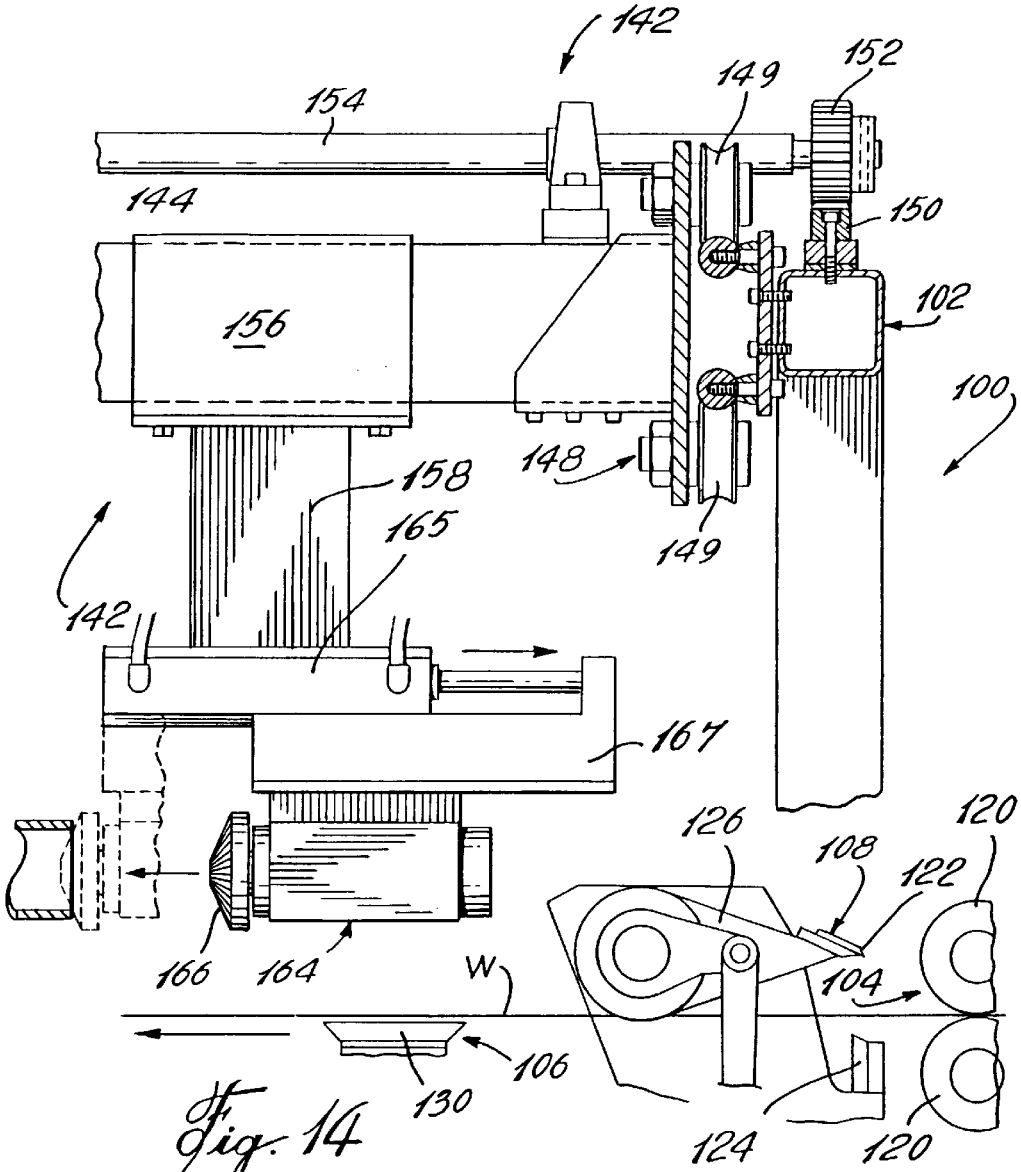
FIG. 14 is an enlarged fragmentary elevation, partly in cross-section, of a detail of the station shown in FIG. 8.
Figure 11:
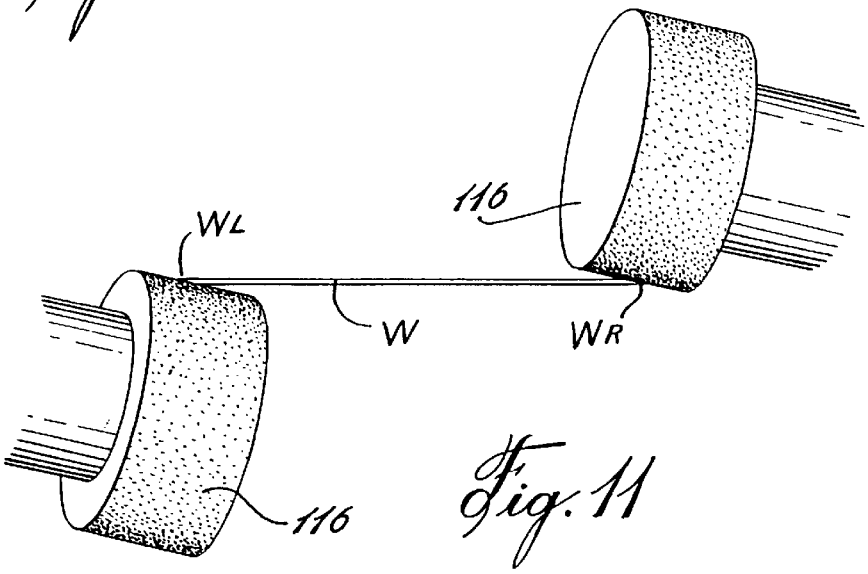
FIG. 11 is a fragmentary perspective view of a detail of the station shown in FIG. 10.

As shown in FIGS. 8 and 9, the core wrapping assembly 100 includes a frame 102. A web feeder and glue assembly 104 is provided at one end of the elongated frame 102. A web assembly 103, as shown in FIG. 10, includes a roll of liner board web W being taken off by the feed assembly 104, and the web W passes through a skiver 114 which includes skiving wheels 116 shown in FIGS. 10 and 11. The skiver, depending on the thickness of the web W, will remove from 0.020 and 0.010 off each edge $W_L$ and $W_R$. The skiving station is upstream from the feed and glue station 104.

The web W moves through the feed assembly 104 and through glue bath 118 and eventually over tension roller assembly 119, including a spring mounted lever, and through the pair of tension rollers 120.

Figure 12:
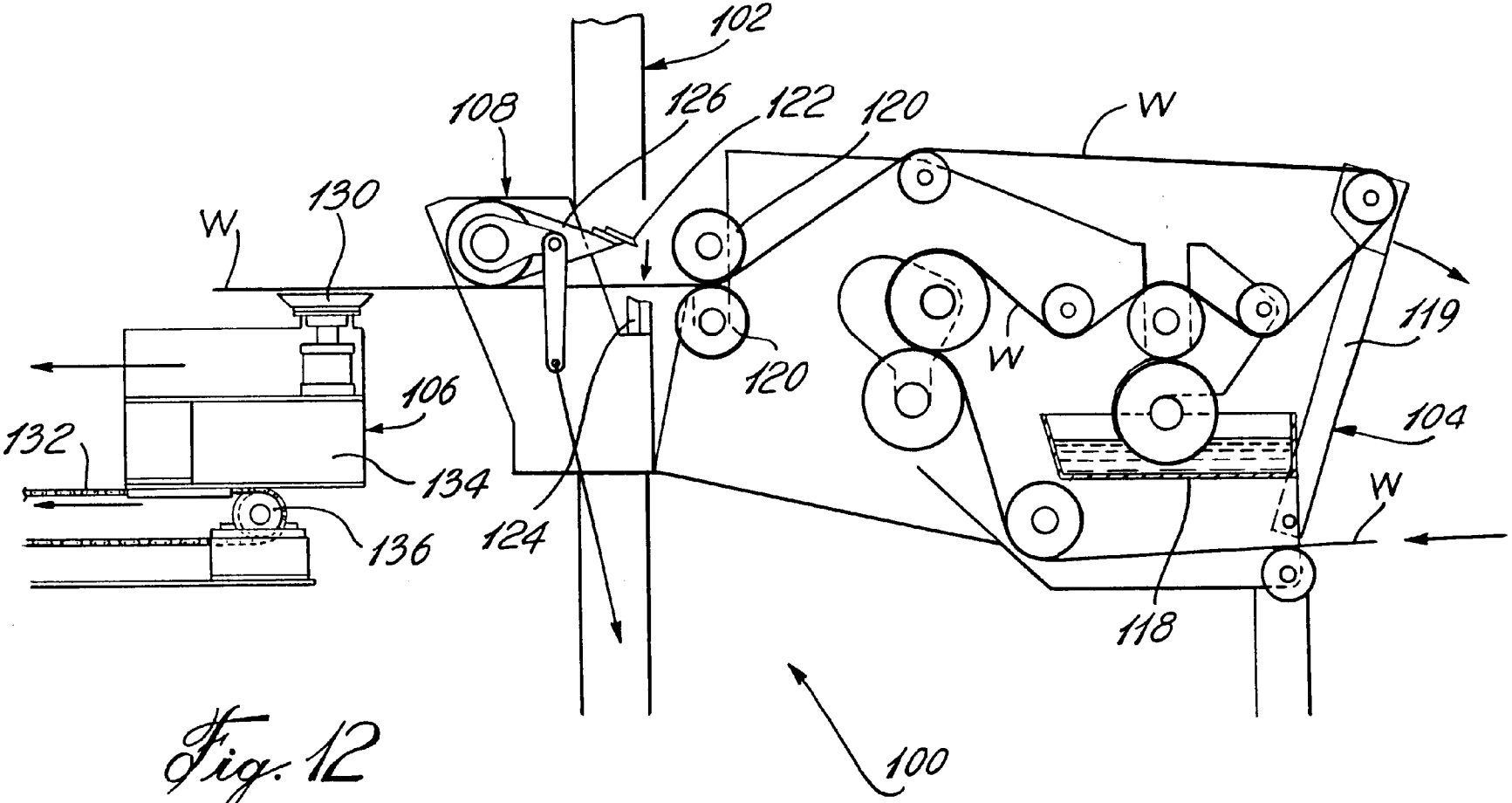
FIG. 12 is an enlarged fragmentary view of a detail of the station shown in FIG. 8.
Figure 15:
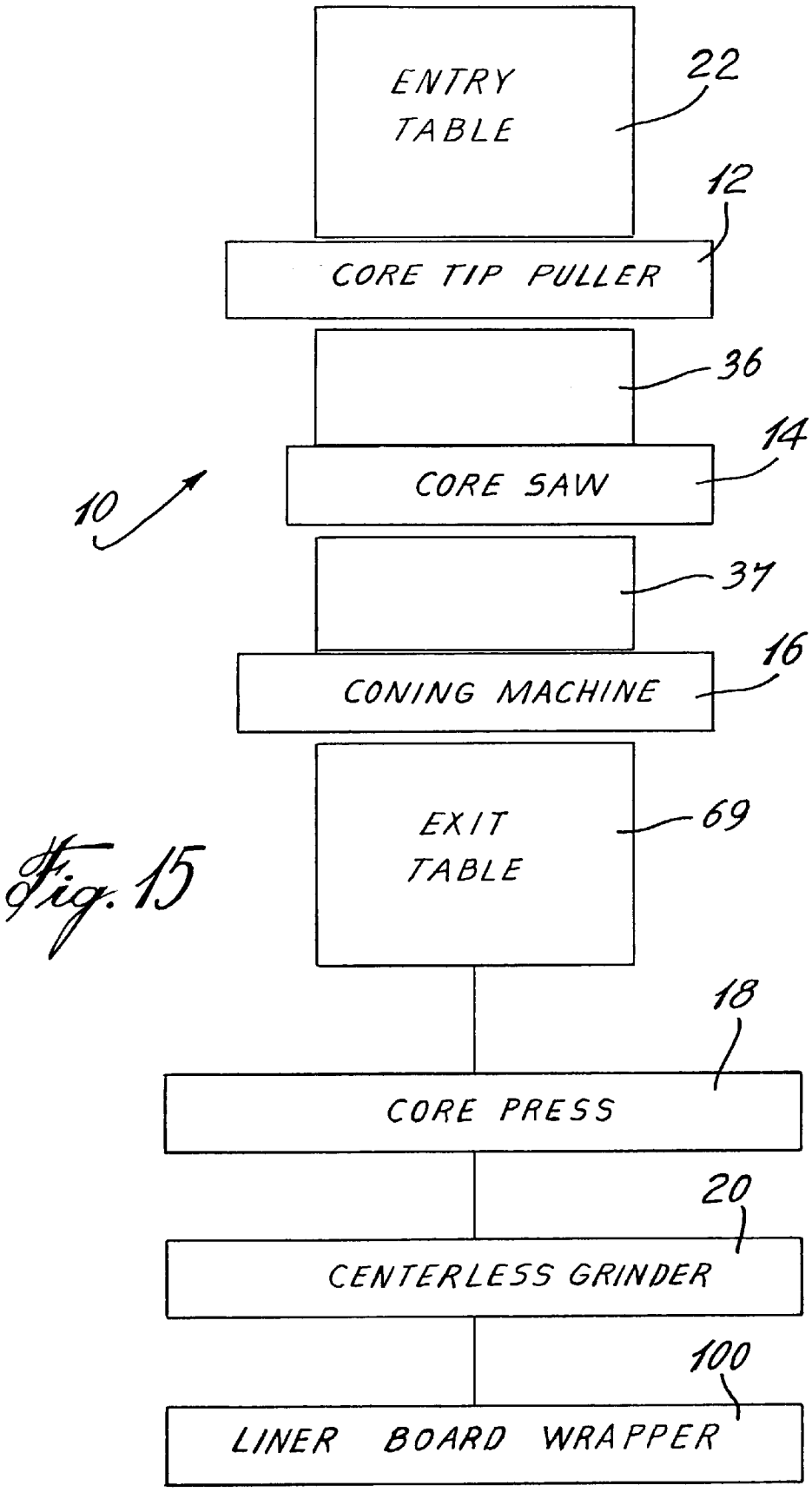
FIG. 15 is a block diagram showing the steps in accordance with the method of the present invention.

Frame 102 is provided with a cutting assembly 108, as shown in FIG. 12, which includes a cutting knife 122 on a pivoting lever 126 which moves in association with anvil 124 in order to cut the web W the exact predetermined length. The length of the web W is determined by the length of the core master $C_M$.

The width of the web W is slightly greater, with the skived edges $W_L$ and $W_R$, than the circumference of the core $C_M$, to be wrapped, so that the skived edges $W_L$ and $W_R$ can overlap at least within the parameters of the skived portions.

Figure 13:
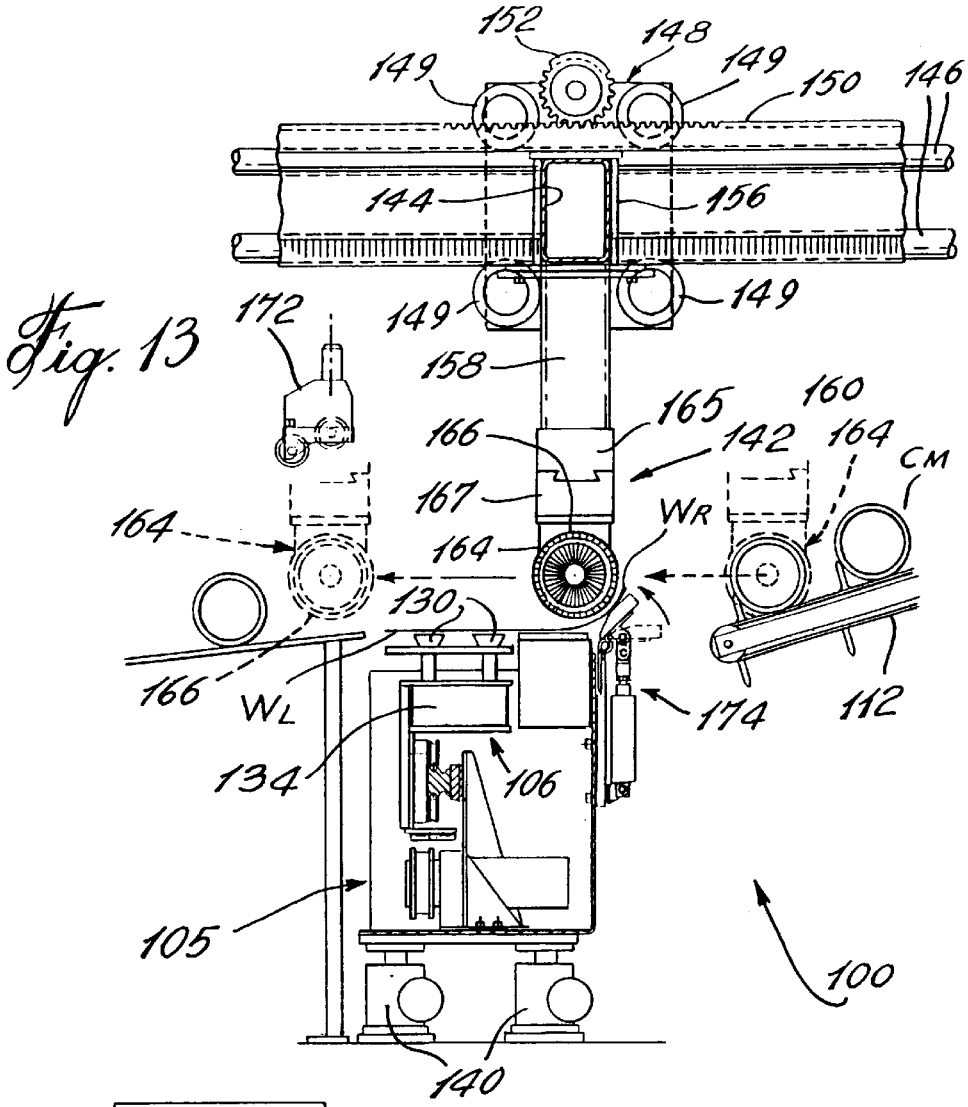
FIG. 13 is a transverse cross-section of the station shown in FIG. 8 and taken along line 13—13 of FIG. 8.

As shown in FIGS. 8, 12, 13, and 14, the web support assembly 105 includes vacuum feed conveyor 106 having suction cups 130 mounted on a vacuum box 134 which in turn is mounted to a conveyor system which moves the vacuum box 134 with vacuum cups 130 along the longitudinal axis of the frame 102. The vacuum cups 130 act on the web W to advance the web W to the full extent required to cover the length of the core master $C_M$. Once the web W has been extended to the predetermined length, the knife assembly 108 is activated to cut the length of the web W. The web W is supported on the frame by the elongated narrow platform 110, as shown in FIG. 13, and by the suction cups 130.

Once the web W has been laid out on the frame 102 as discussed above, a core master $C_M$, in the magazine 112, is lifted by means of a core support assembly 142.

The core support assembly 142 includes a beam 144 which can travel laterally of the frame 102 as will be described later. A pair of spindle assemblies 164 are mounted on the beam 144 for travel along the longitudinal axis thereof. Each assembly 164 includes a sleeve 156 adapted to slide longitudinally on the beam 144, a bracket 158 extending downwardly, and the spindle housing 165 having a spindle head 166. The head 166 is mounted for sliding movement on a sliding sub-housing 167 slidably mounted to the housing 165. The head 166 is rotatable by means of a motor in the sub-housing 167. The head 166 is frusto-conical, and the beveled portion is radially serrated.

The shafts 154, as seen in FIGS. 2 and 3, are driven by motor 170 through the intermediary of shafts 154. The shafts 154 each have a gear 152 which engages rack 150 on the top of the frame 102. Thus, motor 170 is effective to move the core support assembly 142 laterally on frame 102.

As seen in FIG. 13, the pickup assembly 164 is adapted to pick up a core master $C_M$ from the magazine 112 and move it to a position above the lateral center of the web W.

As shown in FIG. 13, web support assembly 105 may be raised, by means of hydraulic jacks 140 in increments corresponding to the different core diameters. Since the web W has been provided with an adhesive on the top surface thereof, the web W will come into contact with the surface of the core master $C_M$. The close contact of the web to the surface of the core master is effected by means of a slicker assembly 174 which is actuated to raise the edge $W_R$. The core master $C_M$ is rotated by the motor (in sub-housing 167) driving the spindle heads 166, and the web W will thus be wrapped about the core surface. A pair of idler rollers 172 is provided to ensure the close contact of the web being rolled to the surface of the core master $C_M$. The skived edges of web W will overlap but will not form a seam of greater thickness than the thickness of the finished web of liner board.

The completed core masters $C_M$ are then removed from frame 102, and the cycle is repeated. The cores $C_M$ are then cut into preferred core lengths. Metal tips may also be added to the restored cores.

I claim:

1. An apparatus for wrapping a layer of material about a cylinder, including an elongated frame, a web material feeding station at one end of the frame for feeding a web of said layer of material and a conveyor for advancing said web along a longitudinal axis of said web, to a fixed position horizontally and longitudinally on the frame, cutting means for cutting a length of said web corresponding to the length of the cylinder to be wrapped, said web having a width equal to the circumference of the cylinder to be wrapped, glue means for applying adhesive to the web, an overhead conveyor for picking up and positioning said cylinder over the cut length of said web on the elongated frame with the axis of the cylinder parallel to the longitudinal axis of said web, means for bringing said web of material and the cylinder into contact such that the adhesive will engage the surface of the cylinder, and means for rotating the cylinder and said cut length of said web so that the layer of material is wrapped completely about the cylinder.

2. An apparatus for wrapping a layer of material about a cylinder as defined in claim 1, wherein the glue means comprises a glue bath associated with the feeding station for applying glue to the web, a magazine adjacent the elongated frame for storing a plurality of cylinders to be wrapped, the cylinders in the magazine being parallel to the axis of the web on the elongated frame, the overhead conveyor including pickup means for engaging one of the cylinders from the magazine and moving one of the cylinders over the length of web on the elongated frame, means to move the one of the cylinders and the web into contact, and chuck means for rotating the one of the cylinders so that the length of web is wrapped about the cylinder.

3. An apparatus for wrapping a layer of material about a cylinder as defined in claim 2, wherein the overhead conveyor includes a traveling overhead beam mounted on the elongated frame, parallel to the cylinders in the magazine, a pair of pickup heads adapted to slide longitudinally of the beam, each pickup head including a spindle assembly including a spindle head and motor means to drive the spindle head in a rotary movement, whereby when the spindle heads engage the ends of the one of the cylinders, the spindle heads may be rotated in order to rotate the one of the cylinders during the wrapping of the web on the cylinder.

4. An apparatus for wrapping a layer of material about a cylinder as defined in claim 3, wherein the traveling overhead beam has motor means and a gear means for moving the beam laterally of the elongated frame between the magazine and a position over the web extending on the elongated frame.

5. An apparatus for wrapping a layer of material about a cylinder as defined in claim 1, wherein skiving means are provided upstream of the feeding station to skive the longitudinal edges of the length of the web being fed, thereby allowing a slight overlapping of the web when it is being wrapped on the cylinder.

6. An apparatus for wrapping a layer of material about a cylinder as defined in claim 1, wherein the conveyor means for moving and extending the web on the elongated frame comprises vacuum suction cups adapted to engage the web from below the web at the feeding station, and conveying means for moving the vacuum suction cups longitudinally and in a horizontal plane on the elongated frame, thereby moving the web.

* * * * *